US005460118A

United States Patent [19]

Shea et al.

[11] Patent Number: 5,460,118

[45] Date of Patent: Oct. 24, 1995

[54] SURFACE MOUNTED MODULAR SIGNAL DEVICE FOR ELEVATORS

[75] Inventors: Timothy S. Shea, Morristown; Surjit S. Sandhu, Neshanic Station, both of N.J.

[73] Assignee: Inventio AG, Hergiswil NW, Switzerland

[21] Appl. No.: 105,941

[22] Filed: Aug. 13, 1993

[51] Int. Cl.[6] ..... B66B 3/00

[52] U.S. Cl. ..... 116/226; 187/395; 187/398

[58] Field of Search ..... 40/450, 544, 550; 116/64, 68, 226; 187/1 R, 380, 395, 397, 398, 399; 340/332; 362/76

[56] References Cited

U.S. PATENT DOCUMENTS

| | | | |
|---|---|---|---|
| 1,803,119 | 4/1931 | Lucas | 116/226 |
| 2,072,439 | 3/1937 | Andres . | |
| 3,952,837 | 4/1976 | Rice . | |
| 4,032,882 | 6/1977 | Mandel et al. | 340/332 X |
| 4,726,449 | 2/1988 | Orndorff et al. | 187/1 R |
| 4,924,974 | 5/1990 | Orndorff et al. | 187/1 R |

FOREIGN PATENT DOCUMENTS

| | | | |
|---|---|---|---|
| 0191142 | 8/1986 | European Pat. Off. | 187/1 R |
| 0524428 | 1/1993 | European Pat. Off. . | |
| 9102425 | 6/1991 | Germany . | |
| 0016755 | 2/1977 | Japan | 187/1 R |
| 0040455 | 3/1979 | Japan | 187/1 R |
| 139272 | 6/1989 | Japan . | |

*Primary Examiner*—William A. Cuchlinski, Jr.
*Assistant Examiner*—Willie Morris Worth
*Attorney, Agent, or Firm*—Sandler, Greenblum & Bernstein

[57] ABSTRACT

A modular signal device which fills the need of the elevator industry for differing types of signal devices wherein a surface mounted base plate includes turned up small ends, with a cover ring surrounding the base plate and utilizing a bolt at one small end and an adjusting screw on the other small end to rearwardly retain the turned up ends, with the cover ring including an inner collar which carries and retains a cover plate, with the cover plate including at least one opening and concentrically arranged second threaded bolts in order to receive switching elements such a push buttons, with first threaded bolts serving to attach the cover plate onto the collar of the cover ring. In further embodiments, the cover plate takes the form of lenses with filters, grids or arrow masks which serve to outwardly convey the signals produced by the signal devices attached to the collar.

3 Claims, 4 Drawing Sheets

SURFACE MOUNTED MODULAR SIGNAL DEVICE FOR ELEVATORS

BACKGROUND OF THE INVENTION

1. Field of the Invention

The invention pertains to a surface mounted signal device for elevators having a base plate with a detachable connection with a housing wherein the base plate has turned up ends that are rearwardly retained, relative to the housing, by retaining means.

2. Discussion of the Background of the Invention and Material Information

European Patent Publication EP-A1 0 524 428 discloses an indicator device of the flat type for elevators wherein a base plate is assembled, with its turned up small ends and attachment screws, to a wall. On the lower small side of a housing, that is open toward the wall, bolts are arranged which serve to connect the lower turned up end of the base plate with the housing. On the upper small side of the housing, adjusting screws serve to connect the upper turned up end of the base plate with the housing. The front side of the housing has an opening for receiving a filter plate. On the front inner side of the housing, near the opening, threaded bolts serve to retain a lens carrier, via clips, with the lens carrier being pressed frontally against the filter plate by means of screw nuts. The rear side is closed by an actuatable or pressable circuit, located on the lens carrier. An insulating plate, arranged on the base plate, protects the pressable circuit against short circuits.

A disadvantage of this known construction is that, with differing indicating devices of the same type, only the base plate is the same in terms of size and shape. Depending upon the lens shape and lens size, housings with differing frontal openings are required.

SUMMARY OF THE INVENTION

The present invention provides a remedy in that it solves the problem inherent in the prior art and produces a modular surface mounted signal device for elevators which fills the need of the elevator industry for differing signal devices.

Specifically, this invention pertains to a surface mounted signal device for elevators having a base plate detachably connected with a housing wherein the base plate has turned-up ends that are rearwardly retained relative to the housing by means for retaining, the housing including a cover ring and a cover plate, carried by the cover ring, wherein the means for retaining is arranged on the cover ring, with the cover ring surrounding the base plate.

The cover ring includes an internal collar, which retains the cover plate, and the cover plate includes at least one opening and second threaded bolts for receiving and retaining means for switching. The cover plate also includes first threaded bolts which serve to connect the cover plate with the collar.

In another embodiment of this invention, the cover plate takes the form of a lens, with a filter being arranged on the underside of the lens. The collar includes a bracket, the bracket carrying a signal device, wherein an output of the signal device is influenced by the filter and is indicated by the lens, with the lens being connected with the collar by means of third screws.

In a further embodiment of this invention the cover plate takes the form of a two piece lens, with the lens having arrow masks, a grid frame and a grid.

The collar includes plates, with the plates in turn having light emitting diodes arranged thereon with the signal produced by the light emitting diodes being indicated by the two piece lens as arrow masks.

Finally, the collar includes a shelf, the shelf retaining at least one loudspeaker, wherein the output of the loudspeaker is projected through the grid.

The advantages achieved by the present invention reside essentially in the fact that the inventive signal device is compatible with the existing product families. An additional advantage lies in the fact that the inventive signal device can be used for both horizontal as well as vertical application. In addition, the modular construction permits production in large numbers which in turn has a positive effect on production costs and the unit price.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have generally been used the same reference characters to denote the same or analogous components and wherein.

DETAILED DESCRIPTION OF THE PREFERRED EMBODIMENTS

Figure 1:
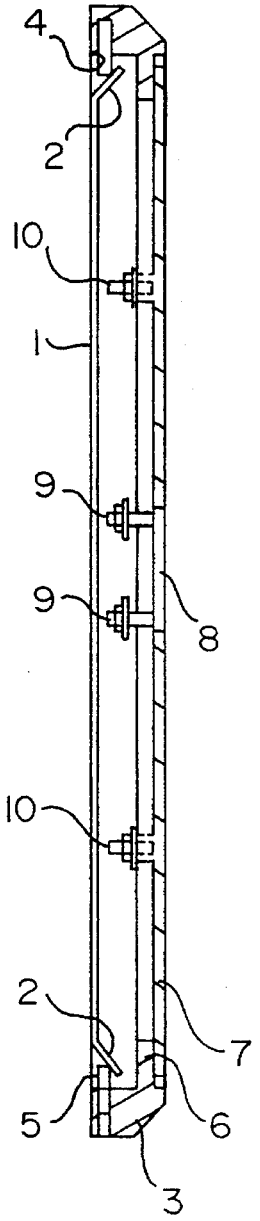
FIG. 1 is a cross sectional view of the signal device of the present invention.
Figure 2:
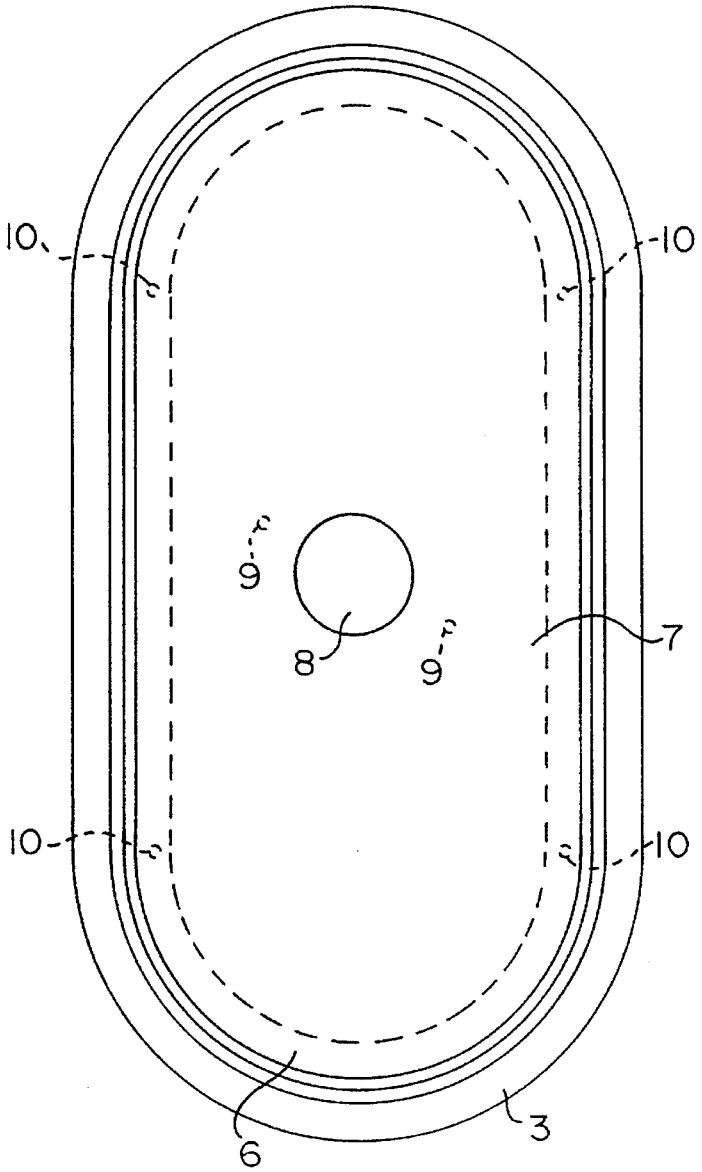
FIG. 2 is a frontal view of the signal device of FIG. 1.

Turning now to the drawings, wherein the invention is illustrated in sufficient detail to permit one to readily understand the present invention, FIGS. 1–8 illustrate three embodiments or variations of the signal device of the present invention. The same parts of the several embodiments are denominated with like numerals. FIGS. 1 and 2 illustrate a first embodiment in which a signal device has a vertically arranged push button or actuator. Numeral 1 denotes a surface mountable base plate 1 having turned up small ends 2. A cover ring 3 surrounds or encloses base plate 1 and includes a bolt 4 on one small end and an adjusting screw 5 at the other small end, with bolt 4 and screw 5 rearwardly retaining turned up ends 2. Cover ring 3 includes an internal collar 6 which in turn carries and retains a cover plate 7. For the retention of switching elements, for example actuators or push buttons, cover plate 7, in this embodiment, includes at least one opening 8 and concentrically arranged second threaded bolts 9 which serve to retain the switching elements on cover plate 7. First threaded bolts 10, in turn, serve to attach cover plate 7 to collar 6 of cover ring 3.

Figure 3:
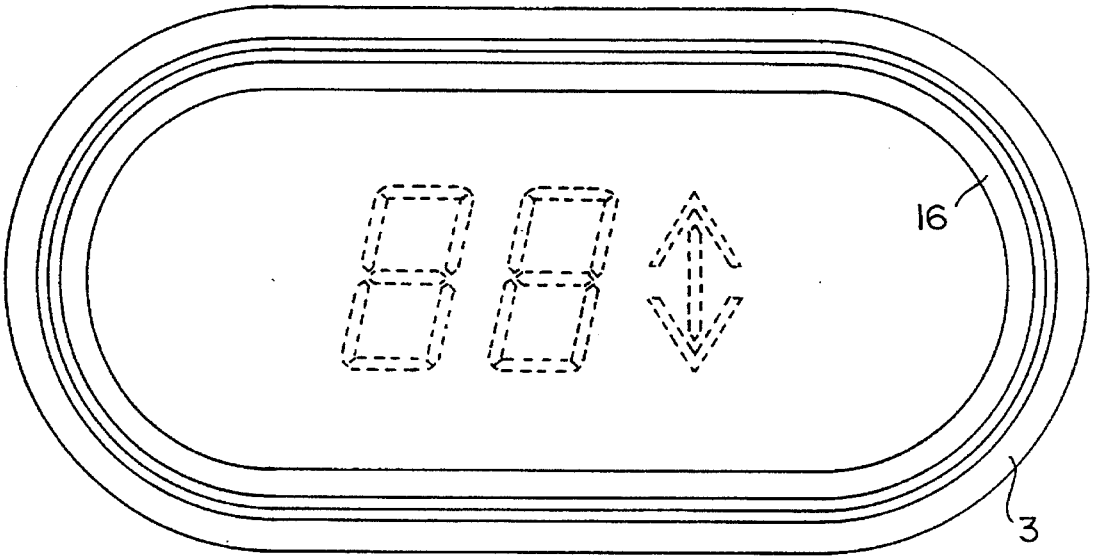
FIG. 3 is a frontal view of the signal device with an indicating element.
Figure 4:
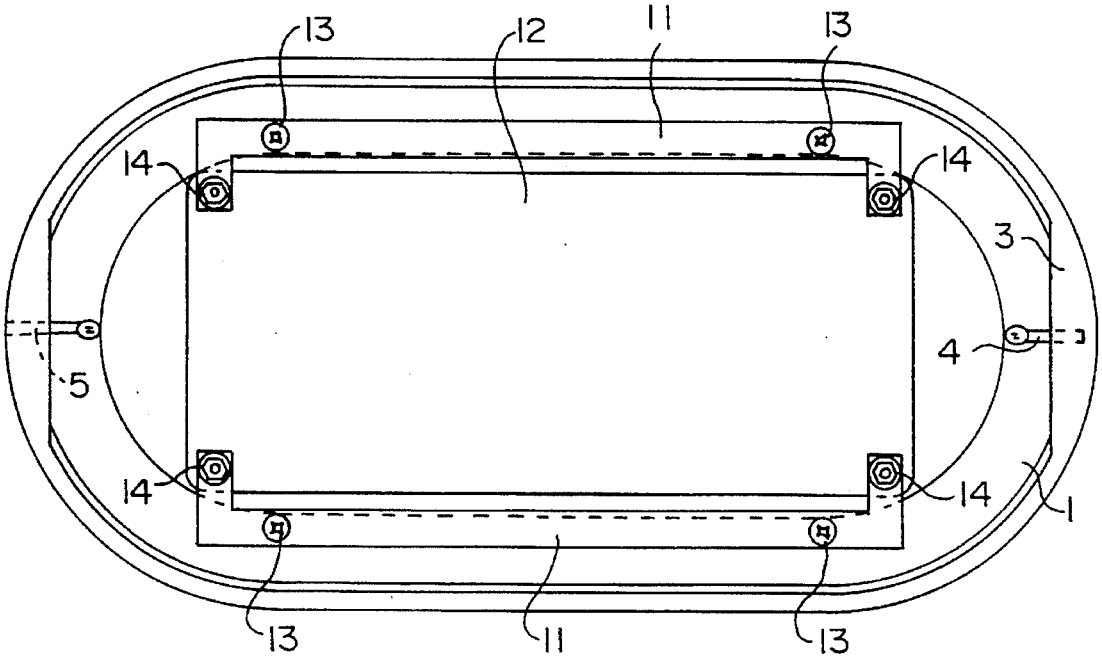
FIG. 4 is a rear view of the signal device of FIG. 3.
Figure 5:
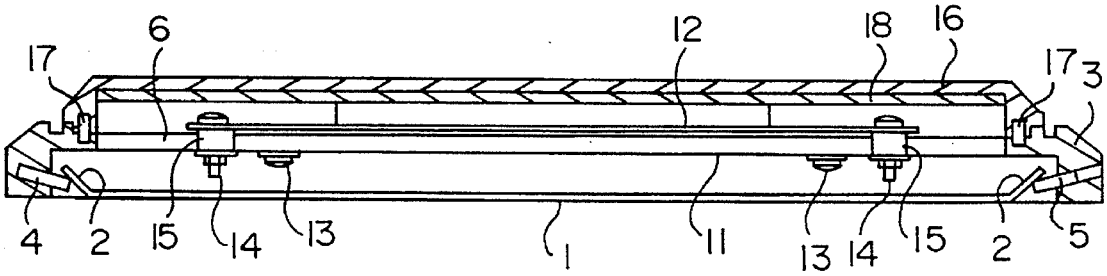
FIG. 5 is a cross sectional view of the signal device of FIGS. 3 and 4.

FIGS. 3, 4 and 5 illustrate a second embodiment of a signal device having an indicating element that is horizontally arranged. Collar 6 of cover ring 3 includes brackets 11 which carry an indicating device 12, for example a seven segment indicator for the representation of alphanumeric symbols. Brackets 11 are connected to collar 6 with second screws 13, with indicating device 12 also being attached to brackets 11 via first screws 14 and spacers 15. In this embodiment, cover plate 7 takes the form of lens 16 which is attached to collar 6 with third screws 17. A filter 18, arranged or secured to the inside surface of lens 16, modifies the light produced by indicating device 12.

Figure 6:
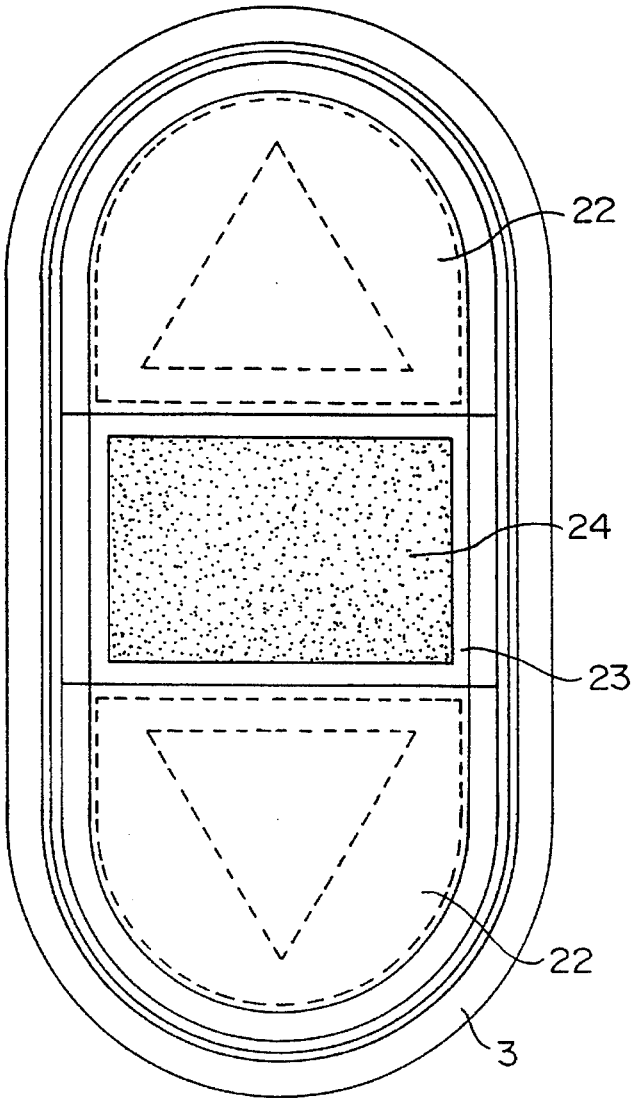
FIG. 6 is a frontal view of the signal device with directional arrows and a loudspeaker.
Figure 7:
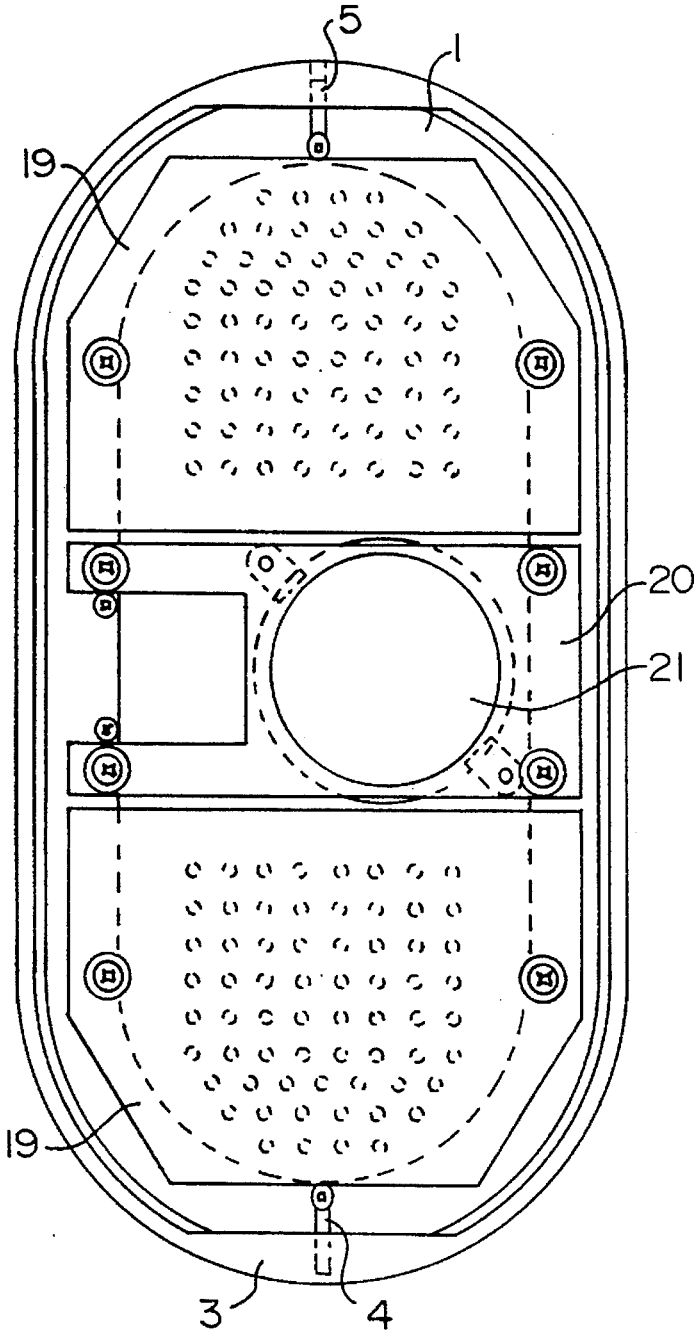
FIG. 7 is a rear view of the signal device of FIG. 6.
Figure 8:
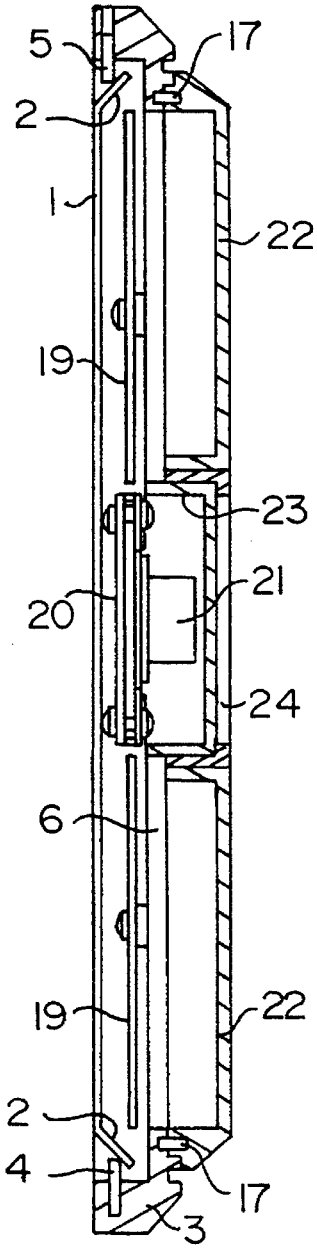
FIG. 8 is a cross sectional view of the signal device of FIGS. 6 and 7.

FIGS. 6, 7 and 8 illustrate a third embodiment in which a signal device, having directional arrows and a loudspeaker, is vertically arranged. Collar 6 of cover ring 3 has two plates 19 and a shelf 20 attached thereto, with plates 19 including a plurality or field of light emitting diodes, while shelf 20 carries a loudspeaker 21. In this embodiment, cover plate 7 takes the form of a two piece lens 22 having arrow masks, a grid frame 23 and a grid 24.

While there are shown and described present preferred embodiments of the invention, it is to be distinctly understood that the invention is not limited thereto, but may be otherwise variously embodied and practiced within the scope of the following claims and the reasonably equivalent structures thereto.

What is claimed is:

1. A surface mounted signal device, including signal means, for elevators having a base plate detachably connected with a housing, wherein said base plate has turned-up ends, said turned up ends being rearwardly retained relative to said housing by means for retaining, said housing including a cover ring and a cover plate, wherein said means for retaining is secured in said cover ring, with said cover ring surrounding said base plate, with said cover ring also including a radially inwardly directed collar, said collar carrying said cover plate and said signal means, means for connecting said cover plate with said collar, and means for connecting said signal means with said collar, wherein said cover plate takes the form of a grid frame, a grid, and a two piece lens, with said lens including arrow masks.

2. The signal device of claim 1, wherein said signal means includes plates attached to said collar, said plates in turn having light emitting diodes arranged thereon such that signals produced by said light emitting diodes are transmitted through said arrow masks.

3. The signal device of claim 1, wherein said signal means includes at least one loudspeaker and said means for connecting said signal means with said collar includes a shelf attached thereto, said shelf in turn having said at least one loudspeaker attached thereto, wherein the output of said loudspeaker is projected through said grid.

* * * * *